US007490911B2

(12) United States Patent
Steinberg et al.

(10) Patent No.: US 7,490,911 B2
(45) Date of Patent: Feb. 17, 2009

(54) DRIVE DEVICE FOR ROTATING AND OSCILLATING A TOOL, AND A COMPATIBLE TOOL FOR MINING

(75) Inventors: Jens Steinberg, Hattingen (DE); Joachim Raschka, Bochum (DE); Ulrich Bechem, Iserlohn-Sümmern (DE)

(73) Assignee: DBT GmbH (DE)

( * ) Notice: Subject to any disclaimer, the term of this patent is extended or adjusted under 35 U.S.C. 154(b) by 377 days.

(21) Appl. No.: 11/454,456

(22) Filed: Jun. 16, 2006

(65) Prior Publication Data

US 2007/0193810 A1 Aug. 23, 2007

(30) Foreign Application Priority Data

Jun. 18, 2005 (DE) ..... 10 2005 028 277

(51) Int. Cl.
*E21C 27/24* (2006.01)

(52) U.S. Cl. ..... 299/85.1; 299/71

(58) Field of Classification Search ..... 299/85.1, 299/69, 71, 79.1

See application file for complete search history.

(56) References Cited

U.S. PATENT DOCUMENTS

2002/0093239 A1 * 7/2002 Sugden ..... 299/71

FOREIGN PATENT DOCUMENTS

| | | |
|---|---|---|
| EP | 0 329 915 A1 | 3/1993 |
| EP | 0 455 994 B1 | 8/1997 |

* cited by examiner

*Primary Examiner*—John Kreck
(74) *Attorney, Agent, or Firm*—Baker & McKenzie LLP

(57) ABSTRACT

A drive device for rotating tools operating with oscillation superimposition, including a drive housing, a carrier sleeve mounted rotatably within the drive housing, a drive shaft mounted rotatably therein, a tool carrier to receive working tools and an oscillation-generating mechanism for generating the oscillation superimposition for the one or more tool carriers. The oscillation-generating mechanism for each tool carrier includes at least two intermediate shafts. The intermediate shafts are connected to the one or more tool carriers via an eccentric component part may be driven synchronously.

27 Claims, 8 Drawing Sheets

DRIVE DEVICE FOR ROTATING AND OSCILLATING A TOOL, AND A COMPATIBLE TOOL FOR MINING

CROSS-REFERENCE TO RELATED APPLICATION

This application claims priority to German Patent Application No. 10 2005 028 277.6 filed on Jun. 18, 2005.

BACKGROUND OF THE INVENTION

The invention relates to a drive device for rotating tools operating with oscillation superimposition exhibiting a drive housing, a carrier sleeve mounted rotatably in the drive housing, a drive shaft mounted rotatably in the carrier sleeve, a tool carrier to receive working tools and an oscillation-generating arrangement for producing the oscillation superimposition for the tool carrier.

In the drive devices of the kind in question with impact superimposition, activation of the impact impulse takes place by means of appropriate striking mechanisms, imbalance generators and, in particular, eccentric shafts, which carry freely rotating or driven working tools. Tools operating with impact superimposition are used in particular in mining, in tunnel construction and in road building, for example when hard rock or other mineral-bearing rock must be loosened, cut or worked in some other way. Impact superimposition permits the necessary pressing forces to be applied to the material intended for loosening or excavation to be reduced to as little as 1/10 of the pressing forces that are necessary without impact superimposition, which permits the use of lighter and smaller tools and machines and, at the same time, increases the extraction performance or daily headway of the tools.

Drive devices of the kind in question for tools on which impacts are superimposed are previously disclosed in EP 329 915 A1 and EP 455 994 B1. The drive devices of the kind in question each comprise a carrier sleeve that is rotatably mounted and is driven by a carrier sleeve drive with an eccentrically arranged internal bore, in which a shaft is rigidly connected to the tool carrier, which shaft is designated in the prior art as an eccentric shaft. The carrier sleeve is provided with counterweights for the dynamic balancing of the drive device, and the eccentric shaft is driven by means of a second drive, which can consist of a separate drive or a reduction drive. In a reduction drive, the speed ratio between the speed of the eccentric shaft and the speed of the carrier sleeve is fixed; in drive devices with a separate drive for the eccentric shaft, the speed ratio is variable within limits. The offset of the eccentric shaft in the carrier sleeve can be 5 mm, for example, and the speed ratio of the faster-rotating eccentric shaft to the more slowly-rotating carrier sleeve can be in the order of 30:1, so that the working tools mounted on the tool carrier strike the material or rock to be mined or worked with a large number of radial impacts. The loosening or mining performance achieved in the case of the tools with impact superimposition of the kind in question is already many times higher than in conventional drive devices without impact superimposition.

However, the considerable vibrations that are introduced into the drive housing and tool housing, the imbalance masses that are required in particular for dynamic balancing, and the service life of the seals and bearings for the eccentric shaft and the carrier sleeve, continue to be problematical in eccentric-induced drive devices with impact superimposition of the kind in question.

BRIEF SUMMARY OF THE INVENTION

The object of the invention is to make available a drive device for rotating tools operating with impact superimposition, in which the bearing and sealing of the drive shaft and carrier sleeve are improved in order to increase the service life of the drive devices and, in particular, of the tools equipped with these.

This and further objects are achieved in accordance with the invention in that the generating device for the impact superimposition is an oscillation-generating arrangement, which exhibits at least two intermediate shafts for each tool carrier, which shafts are connected in each case to the tool carrier via an eccentric component part and are capable of being driven in a synchronous fashion. In terms of their construction, the drive devices in accordance with the invention exhibit a fundamentally different design from that of the drive devices of the kind in question with impact superimposition. The impact induction, which is referred to as oscillation in the invention in order to distinguish it from the state of the art, no longer takes place by means of a single, eccentrically mounted and arranged eccentric shaft, but by means of at least two intermediate shafts, which are connected to the tool carrier in an appropriate manner eccentrically via an eccentric component part and are capable of being driven in a synchronous fashion. Since at least two intermediate shafts are assigned to the one tool carrier, or to each tool carrier, these can have significantly smaller dimensions than in the state of the art, as a consequence of which the sealing of the shafts and the support of the intermediate shafts in bearings are greatly simplified. Also dispensed with at the same time is a carrier sleeve of similar large dimensions, to which a counterweight of correspondingly large dimensions had to be allocated in the state of the art. This is no longer necessary, on the other hand, in the construction in accordance with the invention with a plurality of smaller intermediate shafts. The drive device in accordance with the invention can thus be used to drive tools which operate with oscillation superimposition, which tools can be of a significantly larger size and more versatile than in the state of the art, but without the bearing or the shaft sealing of the intermediate shafts, the carrier sleeve and/or the drive shaft being problematical. A further advantage, in accordance with the invention, is that the entire part on the drive side is not subjected to the oscillations of the tool carriers produced by the oscillation-generating arrangements.

In a particularly advantageous embodiment of the invention, all the intermediate shafts are supported in bearings concentrically to the axis of rotation of the drive shaft in the carrier sleeve. In this construction, therefore, not only the drive shaft is supported in bearings concentrically to the carrier sleeve, but also all the intermediate shafts are supported in bearings concentrically to their common axis of rotation. The plurality of intermediate shafts can then be distributed in particular symmetrically, and can be arranged and supported in bearings around the axis of rotation of the drive shaft arranged on a peripheral circle. In this construction, the driving of the drive shaft and the driving of the carrier sleeve can take place in a particularly simple manner, since both the carrier sleeve and the drive shaft rotate concentrically about a common axis of rotation.

In a further preferred embodiment of the drive device, the intermediate shafts can be connected to the drive shaft via a gear mechanism, and particularly advantageously via a toothed gear mechanism. The use of a toothed gear mechanism is made possible by the fact that the axes of rotation of the intermediate shafts exhibit a constant distance to the common axis of rotation of the drive shaft and the carrier sleeve, regardless of their instantaneous position.

In accordance with one advantageous embodiment, the toothed gear mechanism can exhibit a central toothed wheel that is rigidly connected to the drive shaft and planet wheels that are each rigidly connected to the intermediate shafts and are in toothed engagement with the central wheel. In an alternative embodiment, the toothed gear mechanism can exhibit a central toothed wheel that is rigidly attached to the drive shaft and planet wheels that are each rigidly attached to the intermediate shafts, in conjunction with which intermediate toothed wheels are arranged additionally between the central toothed wheel and the planet wheels, which intermediate toothed wheels are supported in bearings in the carrier sleeve in such a way that they are free to rotate. In the case of planet wheels that are connected directly to the central toothed wheel, relatively high speeds of rotation can be achieved for the intermediate shafts, whereas in the construction with intermediate toothed wheels, the speed of the intermediate shafts can correspond essentially or precisely to the speed of the drive shaft. The latter is particularly advantageous if a balancing weight that is rigidly connected to the drive shaft is allocated to an individual tool carrier. It will be obvious in this case to a person skilled in the art that the multiplication ratio or the reduction ratio depends on the constructive layout of the individual toothed wheels.

A further major advantage of the solution in accordance with the invention is that the eccentricity is formed directly between the tool carrier and the intermediate shafts and is achieved by means of the eccentric component parts. In an embodiment in accordance with the invention, the eccentric component parts can be constituent parts of the intermediate shafts and can be constituted by an eccentric pin arranged eccentrically to the central axis of the intermediate shaft. One-piece intermediate shafts, on which the eccentric pin is integrally formed, are provided in this embodiment, therefore. In an alternative construction, the eccentric component parts can be shaft prolongations arranged eccentrically to the central axis of the intermediate shaft, which are attached to the intermediate shaft in a detachable fashion. In the construction with detachable shaft prolongations, it is particularly advantageous if the intermediate shafts and the shaft prolongations are connected via a conical taper prolongation, which engages in a conical depression in the second part. Since the intermediate shafts normally exhibit a greater diameter than the shaft prolongations, the depression can preferably be executed in the intermediate shaft. The reverse arrangement is also possible, however. It is then particularly advantageous if the rigid connection between the taper prolongation and the depression is secured by means of a securing means.

As a further alternative, instead of intermediate shafts with eccentric shaft prolongations, intermediate shafts with concentric shaft pins can also be used, in conjunction with which the eccentric component parts are then formed by means of sleeves with an eccentric shaft seat. The shaft pins in this case engage in the shaft seats, whereby the eccentric arrangement between the intermediate shafts and the tool carriers is formed. In this case, too, it is advantageous if the shaft seat and the shaft pin are of conical execution and engage rigidly into one another, in conjunction with which the rigid connection is preferably secured with the help of a securing means. A connection with conical parts facilitates the dismantling of the one or mote tool carriers from the component part on the drive side, which comprises the carrier sleeve, the drive shaft and the bearing for the intermediate shafts. As an alternative to screwed connections as a securing means, the rigid connection between the conical parts can also consist of an oil press fit connection or a press fit that can be released by subjecting it to pressure with hydraulic means. Assembly is then effected by means of a pressing-on process, in conjunction with which oil or some other hydraulic means is forced into the joint gap between the conical parts in order to dilate the external part for assembly. The necessary pressing force can be achieved with a multiplier or a hydraulic press, for example. It goes without saying that dilation of the outer conical part by means of the hydraulic means must also take place for the purposes of dismantling.

One pivot bearing and, in the case of tool carriers with larger dimensions or depths, two or more pivot bearings, is/are appropriately arranged in each case between the eccentric component part and the tool carrier. Only these pivot bearings are required to handle the eccentric rotation of the shaft prolongations or the shaft pins on the intermediate shafts. However, since the dimensions of the sleeves, the shaft pins or the shaft prolongations are relatively small because of the plurality of intermediate shafts, the service life of the bearings and the shaft seals presents no problems in spite of the eccentricity.

The drive device or a tool with the drive device can be executed in numerous different ways. According to one preferred embodiment, the drive device or the tool exhibits a plurality of tool carriers, in conjunction with which at least two intermediate shafts are connected to each tool carrier. In one embodiment with a plurality of tool carriers, it is particularly advantageous if the vibration produced by the oscillation-generating arrangement for the first tool carrier is out-of-phase in relation to the one or more vibrations produced by the one or more additional oscillation-generating arrangements. In this embodiment, therefore, it is possible for the dynamic balancing of a tool carrier to take place exclusively via a phase-displaced oscillation of at least one additional tool carrier.

According to a particularly advantageous embodiment, an even number of tool carriers can be provided, in conjunction with which in each case the mutually opposing tool carriers are superimposed with an oscillation impulse having a phase displaced by 180° through the arrangement of the eccentric component parts of the intermediate shafts of the associated oscillation-generating arrangements. In the case of two tool carriers, for example, these tool carriers are superimposed with an oscillation impulse having a phase displaced by 180°, and the oscillation impulse is directed either to the outside or to the inside at a set time, for example in the case of both tool carriers. Two pairs are produced in each case, for example, in the case of four tool carriers, in conjunction with which, within one pair, two tool carriers are superimposed with an oscillation impulse having a phase displaced by 180° and, particularly advantageously, a phase displacement of 90° exists between the pairs. All four tool carriers can be arranged in a single plane in this case. According to a second advantageous embodiment, three tool carriers are provided, in conjunction with which the individual tool carriers are superimposed with an oscillation impulse having a phase displaced by 120°, through the arrangement of the eccentric component parts of the intermediate shafts of the associated oscillation-generating arrangements. In this case, too, the dynamic balancing takes place exclusively through the phase-displaced superimposition of the oscillation impulses of the three other tool carriers, without the need for additional balance weights.

According to a further, alternative embodiment, two tool carriers arranged in different planes can be provided, which are superimposed with an oscillation impulse having a phase displaced by 180° through the arrangement of the eccentric component parts of the intermediate shafts of the associated oscillation-generating arrangements. The embodiment with tool carriers arranged in different planes has the advantage, to the extent that the working tools attached to it also lie in different planes, that the pressing forces, which are applied by a feed drive mechanism, for example, are further reduced, since the individual tool carriers are not in simultaneous engagement with the rock to be excavated at any time. Especially in the case of the last-mentioned embodiment, it is particularly advantageous if three intermediate shafts are allocated to each tool carrier, which shafts are distributed alternately around the periphery. In order to permit the arrangement in two different planes, the associated tool carriers can be of a spade-shaped, propeller-shaped or star-shaped execution in particular. An arrangement with three intermediate shafts can also be effected, however, in the case of drive devices and tools with only two tool carriers, or even with only a single tool carrier, and/or in the case of spade-shaped or propeller-shaped tool carriers, the location areas for the working tools can also be executed on the tool carriers by means of interleaving or off-setting in such a way that the working tools lie and act in a single plane.

In an embodiment in accordance with the invention with only a single tool carrier, this can also be driven with a higher number, for example six, of synchronously rotating intermediate shafts. In the embodiment with only a single tool carrier, there is then actually a requirement for a balance weight, which preferably rotates in the same direction about the drive axis of the drive shaft with a phase displacement of 180° in relation to the oscillation impulse generated by means of the eccentric components of all the intermediate shafts.

The tools can be attached directly to the tool carrier. It is particularly advantageous, however, if single-component or multiple-component tool holders in the form of an annular segment are attached to each tool carrier with attachment devices for a plurality of working tools. The drive device in accordance with the invention can be used for boring, cutting or the excavation of rock and minerals. The working tools used can consist in particular of self-sharpening round chisel bits, flat chisel bits, discs or cross roller bits. It is also advantageous if the carrier sleeve is driven during operation at a considerably slower speed than the intermediate shafts, in conjunction with which the speed ratio preferably lies between the speed $N_Z$ of the intermediate shafts and the speed $N_T$ of the carrier sleeves >22 and in particular between 25:1 and about 31:1, depending on the nature of the rock to be excavated and the number of working tools, etc. The carrier sleeves can preferably also be driven with a carrier sleeve drive, and the intermediate shafts with an intermediate shaft drive allocated to the drive shaft, and a feed speed for the drive device is adjustable via a feed drive mechanism, in conjunction with which a control device controls the carrier sleeve drive and the feed drive depending on the intermediate shaft drive and thus on the drive for the drive shaft. The connection between the intermediate shaft drive and the carrier sleeve drive can also be effected by means of a gear mechanism with a fixed multiplication ratio.

BRIEF DESCRIPTION OF THE SEVERAL VIEWS OF THE DRAWINGS

Further advantages and embodiments of the invention can be appreciated from the following description of illustrative embodiments represented schematically in the drawing of drive devices in accordance with the invention and of tools on which impacts are superimposed having drive devices in accordance with the invention. In the drawing.

DETAILED DESCRIPTION OF THE INVENTION

Figure 2:
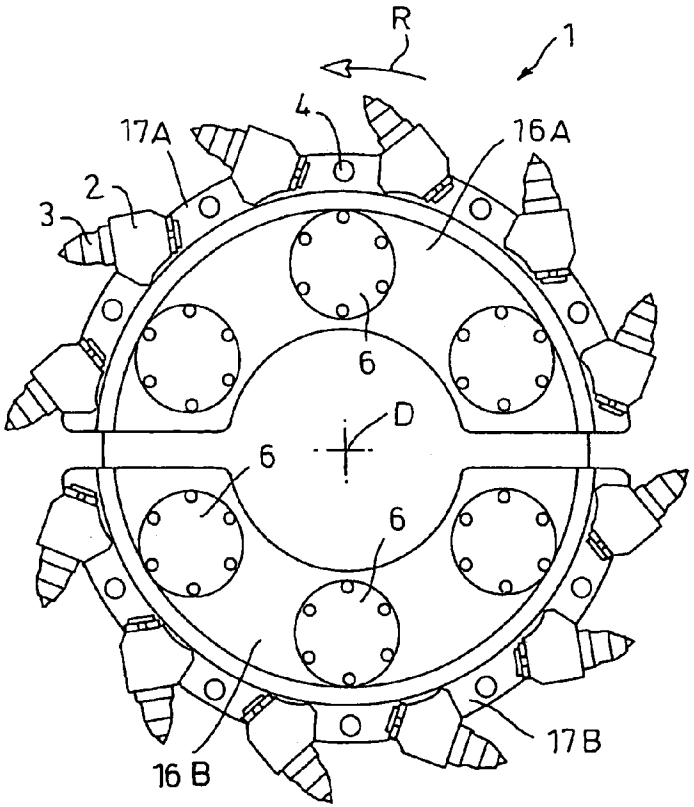
FIG. 2 is a view from the front of the tool carrier illustrated in FIG. 1 equipped with working tools.
Figure 1:
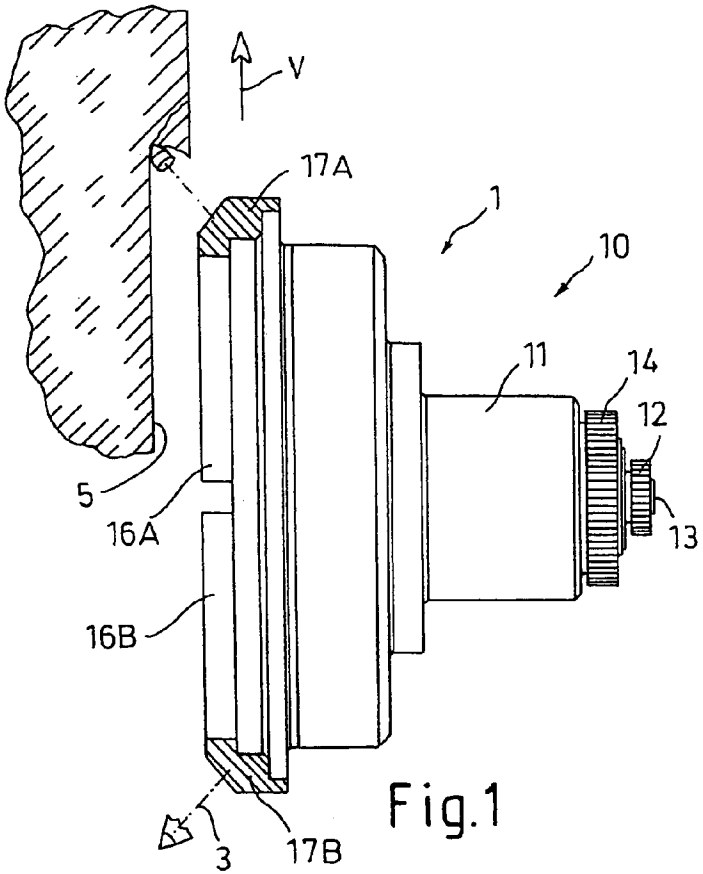
FIG. 1 is a schematic representation as a side view of a drive device in accordance with the invention equipped with working tools.

Represented in FIGS. 1 and 2 is only a single drive device 10 for producing or causing the impact superimposition of a tool operating with impact superimposition and generally designated by the reference designation 1, which exhibits a drive housing 11, a drive shaft 13 capable of being driven via a toothed wheel 12, a carrier sleeve (15, FIG. 3) capable of being driven via a toothed wheel 14 and mounted rotatably inside the drive housing 11, shown here together with two tool carriers 16A, 16B in the form of half discs. The drives connected to the toothed wheels 12, 14 and other component parts of the tool are not illustrated. Detachably attached to each tool carrier is a semi-annular-shaped tool holder 17A, 17B, which are equipped here in each case with six round shaft chisel bits 3 as working tools arranged in tool holding fixtures 2. The two tool holders 17A, 17B are executed in the form of annular segments, lie against the edges of the tool carriers 16A, 16B with positive engagement, and are detachably attached there by means of screwed connections 4. When the tool 1 is being used at a working face 5 with rock to be excavated, in particular hard rock, the tips of the chisel bits of the working tools 3 are in engagement and remove lumps of material at the working face 5 as the tool 1 is caused to advance in the direction of the arrow V in FIG. 1. During operation, the toothed wheel 14 that is connected to the carrier sleeve in such a way as to be incapable of rotation is driven via the carrier sleeve drive, not illustrated here, as a consequence of which the tool carriers 16A, 16B are jointly caused to rotate in the direction of the arrow R in FIG. 2. In addition to the rotation in the direction of the arrow R, the two tool holders 16A, 16B move eccentrically about axes of rotation of intermediate shafts, which, as will be explained below, are driven by means of the drive shaft 13 and an intermediate shaft drive attached to the toothed wheel 12, as a consequence of which the working tools 3 are also subjected to an impact pulse in addition to the rotation, which impact pulse significantly improves the removal of the rock at the working face 5, as is already familiar for tools operating with impact superimposition. The intermediate shafts, by means of which the tool carriers 16A, 16B are subjected to the impact superimposition, referred to below as oscillation superimposition, are accessible in each case from the front side of the tool 1 or the tool carrier 16A, 16B via hatch covers 6. In the illustrative embodiment according to FIGS. 1 to 4, three intermediate shafts are thus provided in each case for each tool carrier 16A, 16B.

Figure 3:
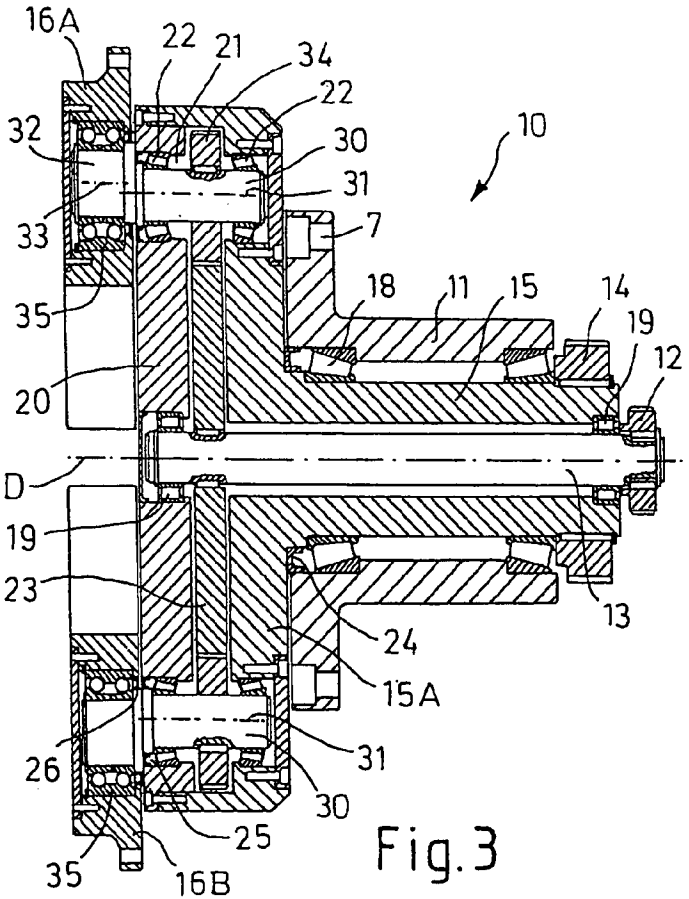
FIG. 3 is a vertical section through a drive device in accordance with the invention according to a first illustrative embodiment.

The construction of the drive device 10 is now explained with reference to FIGS. 3 and 4, which show a first illustrative embodiment of the drive device 10 in accordance with the invention. FIG. 3 shows a sectioned view of the carrier sleeve 15 mounted rotatably on the inside of the housing 11 via the bearings 18 and the drive shaft 13 mounted in turn via bearings 19 in a centric sleeve bore of the carrier sleeve 15. The drive housing 11 is provided with screw seats 7, so that the entire drive device can be removed as a compact unit from the frame or the housing of a tool. Unlike the tools operating with impact superimposition and the drive devices that are familiar from the state of the art, in the drive device 10 in accordance with the invention both the drive shaft 13 and the carrier sleeve 15 exhibit the identical axis of rotation, designated with D, and the carrier sleeve 15 and the drive shaft 13 therefore rotate relative to one another without eccentricity.

The carrier sleeve 15 broadens out at one end into a carrier sleeve head 15A, to the front side of which a sealing disc 20 is attached, which also carries the front bearing 19 for the drive shaft 13. Both the head 15A and the sealing disc 20 are each provided in this case with a total of six seats 21 for intermediate shafts 30, to which the tool carriers 16A and 16B are attached in each case via an eccentric component part 32. In the illustrative embodiment according to FIG. 3, the eccentric component part consists of a shaft prolongation 32 executed integrally on the intermediate shaft 30, the central axis 33 of which prolongation is arranged eccentrically to the shaft axis 31 of the intermediate shafts 30. All the intermediate shafts 30 are supported by the shaft bearings 22 in the seats 21 in the carrier sleeve 15 and the sealing disc 20 in such a way that their shaft axes 31 are arranged concentrically around the rotating shaft D. Each intermediate shaft 30 is rigidly attached to a toothed wheel 34, which is in toothed engagement with a central toothed wheel 23, which is rigidly attached to the drive shaft 13. The toothed wheels 34 allocated to the intermediate shafts 30 thus form planet wheels, which are driven simultaneously and synchronously by means of the central toothed wheel 23, so that all the intermediate shafts 30 rotate synchronously. The eccentric component parts 32 on the intermediate shafts 30 are arranged in such a way that all the intermediate shafts allocated to a tool carrier 16A and 16B rotate with the same eccentricity. This can be appreciated particularly clearly from FIG. 4, in which each of the eccentric component parts 32 of the three intermediate shafts that are allocated to the tool carrier 16A are displaced downwards in the same direction and with the same eccentricity in relation to the shaft axis 31 of the intermediate shafts, whereas the eccentric component parts 21 of the intermediate shafts connected to the tool carrier 16B lie displaced upwards in the indicated oscillation position of the tool carriers 16A, 16B. The intermediate shafts in this case each rotate at the same speed in relation to one another in the direction of the arrow Z in FIG. 4, in conjunction with which the speed of the intermediate shafts 30 and the eccentric component parts depends on the drive speed of the drive shaft 13 and the multiplication ratio of the toothed gear mechanism formed by the central wheel 23 and the planet wheels 34. In the illustrative embodiment with the two tool carriers 16A, 16B, the eccentric component parts 32 are arranged in relation to the associated intermediate shafts 30 in such a way that an oscillation is produced in the tool carrier 16B having a phase displacement of 180° in relation to that of the tool carrier 16A. This has the particular advantage that one of the tool carriers 16A in each case forms the balance weight for the dynamic balancing of the movement of the other tool carrier 16B. There is accordingly no need for an additional balance weight.

In the drive device 10 in accordance with the invention, neither the shaft seals 24 between the drive housing 11 and the carrier sleeve 15 nor the shaft seals 25 on the seats 21 in the sealing disc 20, nor the shaft seals 26 between the eccentric component parts 32 and the tool carriers 16A, 16B are subjected to eccentric movements. Every tool carrier 16A, 16B is rotatably connected to the intermediate shafts 30 by means of a plurality of, in this case three, eccentric component parts 32 and associated bearings 35 for the eccentric component parts, so that the bearings 18, 22 and 35 are also not exposed to any excessive impact loadings, which are produced with the oscillation superimposition in the drive device 10.

Figure 5:
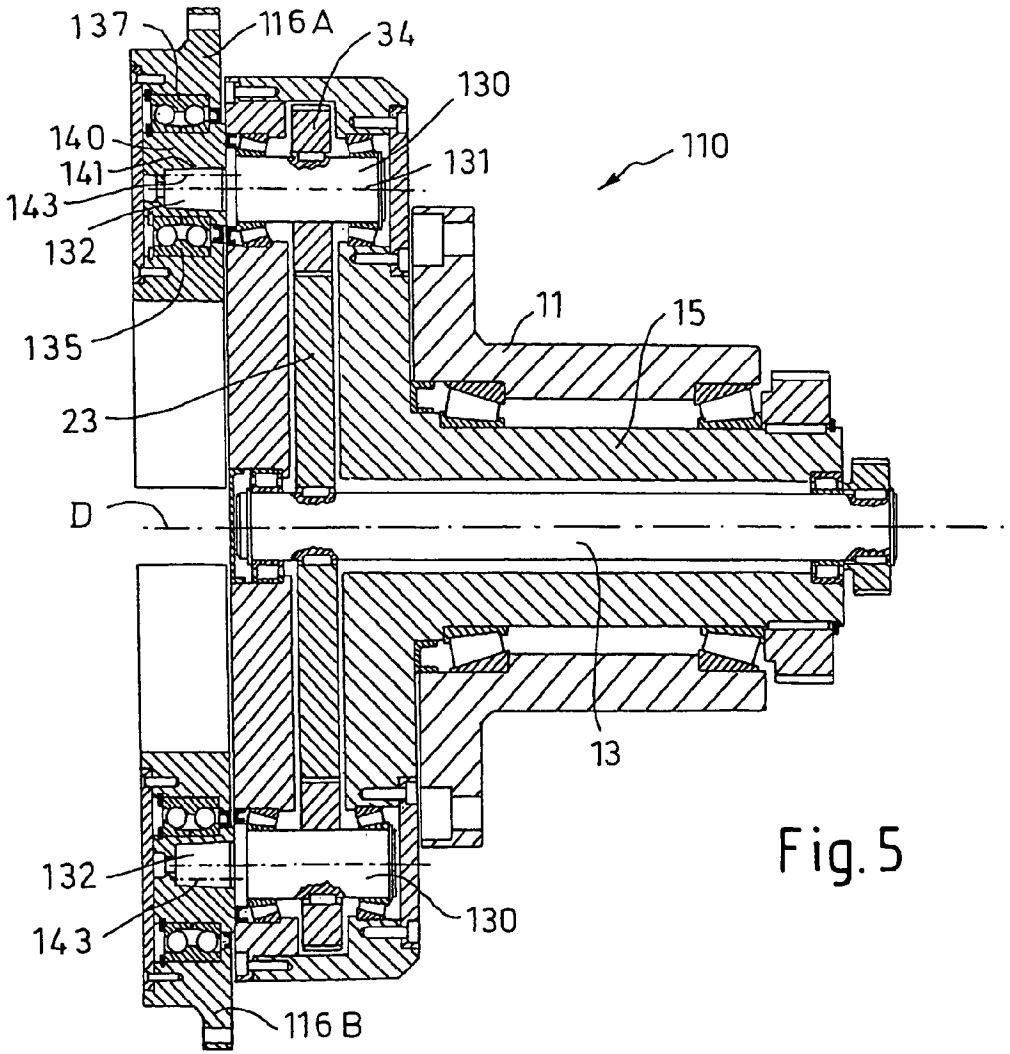
FIG. 5 is a drive device in accordance with the invention according to a second illustrative embodiment shown in a vertical section according to FIG. 3.

FIG. 5 shows a second illustrative embodiment of a drive device 110 in accordance with the invention. Structurally and functionally identical components to those in the first illustrative embodiment are provided with identical reference designations, and a carrier sleeve 15 and a drive shaft 13 are also supported concentrically in bearings about the axis of rotation D in a drive housing 11 in drive device 110. On the other hand, in the drive device 110, two tool carriers 116A, 116B are connected to intermediate shafts 130 via an eccentric component part in such a way that an oscillation-generating arrangement for each tool carrier 116A, 116B is formed with the intermediate shafts 130. Both of the half-disc-shaped tool carriers 116A, 116B lying in a single plane are connected in each case to the eccentric component parts 132 of three intermediate shafts 130, and the intermediate shafts 130 of every tool carrier 116A, 116B are synchronously driven. The rotating drive for the intermediate shafts 130, on the other hand, consists of a central toothed wheel 23 rigidly connected to the drive shaft 13 and planet wheels 34 rigidly connected to the intermediate shafts 130. Unlike the first illustrative embodiment, however, the intermediate shafts 130 exhibit a shaft pin 132 executed concentrically to the shaft axis 131 and projecting into a bearing seat 137 in the tool carriers 116A, 116B, which pin is executed as cone and is attached to one sleeve 140 with eccentrically arranged shaft seats 141. The central axis 143 of the sleeves 140, which corresponds to the central axis of the bearings 135, is indicated schematically in FIG. 5. Because of the bearings 135 arranged between the sleeves 140 and the tool carriers 116A and 116B, as in the first illustrative embodiment, the tool carriers 116A and 116B in each case can still move additionally to the rotation of the carrier sleeve 15 about the axes 131 of the intermediate shafts 130 in an oscillation movement, as a consequence of which, on the other hand, a tool equipped with the drive device 110 receives an impact superimposition or an oscillation superimposition for the working tools. The shaft seat 141 in the sleeve 140 is adapted to the shaft pins 143, which are also conical, in order to be able to separate the sleeve 140 and the intermediate shaft 130 easily from one another. The eccentric component parts, that is to say the sleeves 140 in this case, are also arranged in such a way in the drive device 110 that all of the sleeves 140 allocated to the tool carrier 116A and all of the sleeves 140 allocated to the tool carrier 116B together exhibit an eccentric displacement in the same direction and of the same order of magnitude, although at the same time the tool carrier 116A relative to the tool carrier 116B receives an oscillation superimposition having a phase displaced through 180°, so that dynamic balancing of the drive device 110 by means of additional balance weights is not necessary.

Figure 6A:
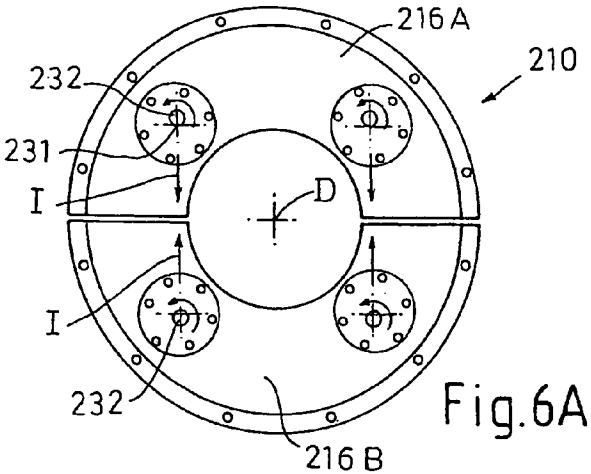
FIGS. 6A-6D illustrate schematically the sequence of the movements of the tool carriers in a drive device according to a third illustrative embodiment.
Figure 6B:
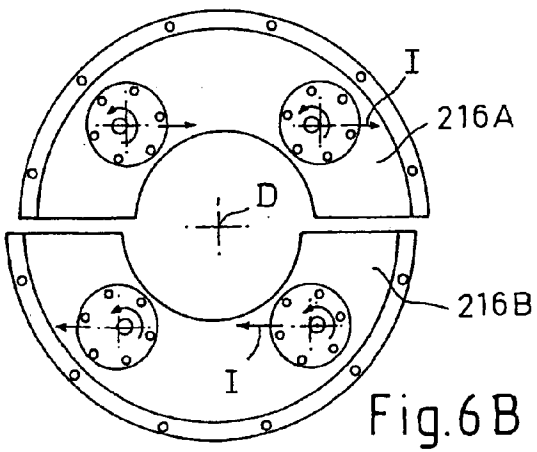
Figure 6C:
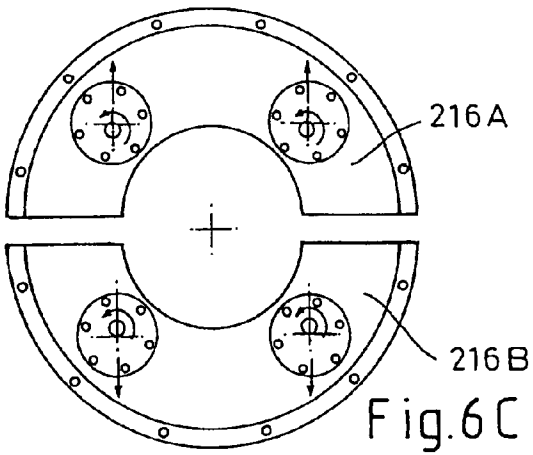
Figure 6D:
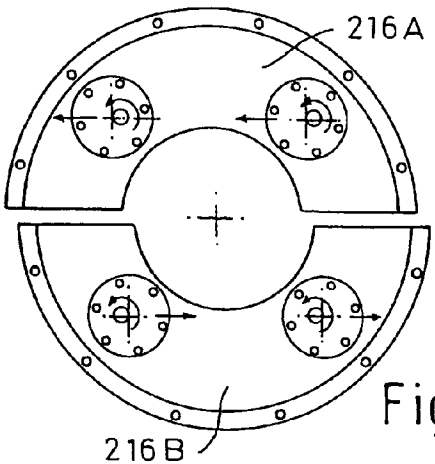
Figure 7A:
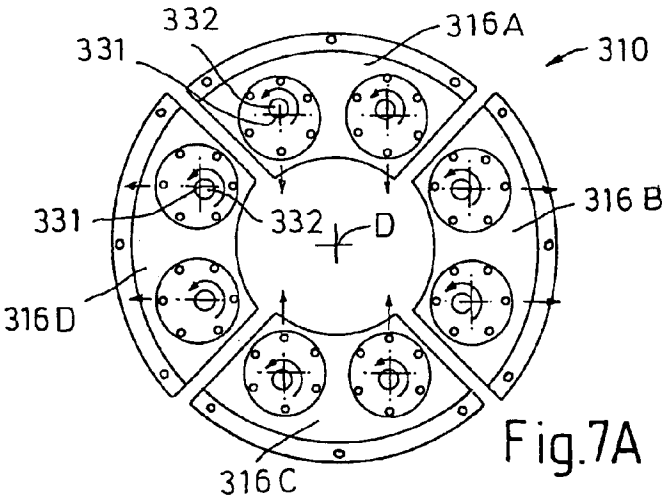
FIGS. 7A-7D illustrate schematically the sequence of the movements of the tool carriers in a drive device according to a fourth illustrative embodiment.
Figure 7B:
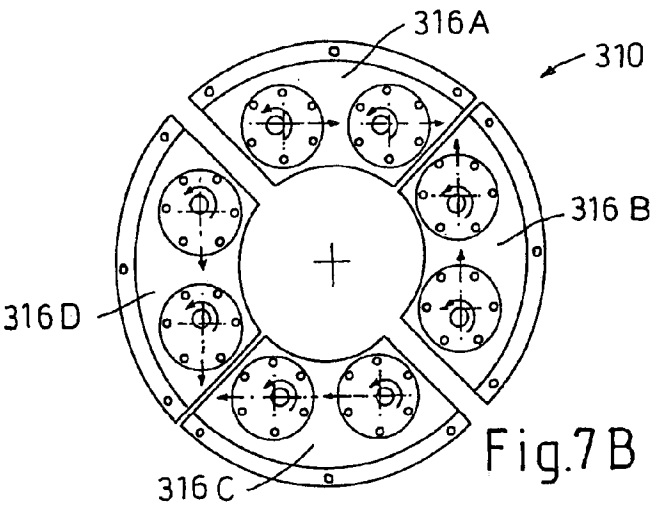
Figure 7C:
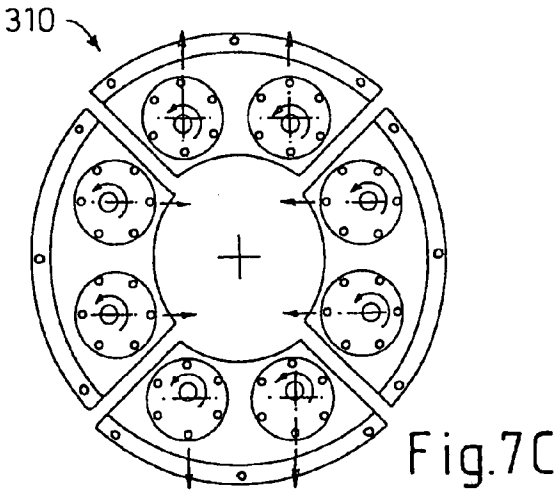
Figure 7D:
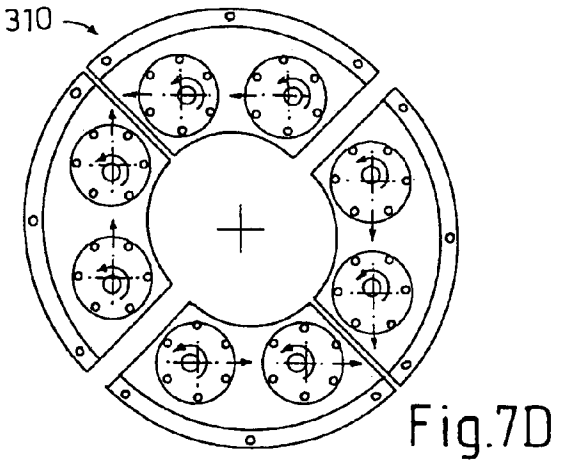
Figure 8D:
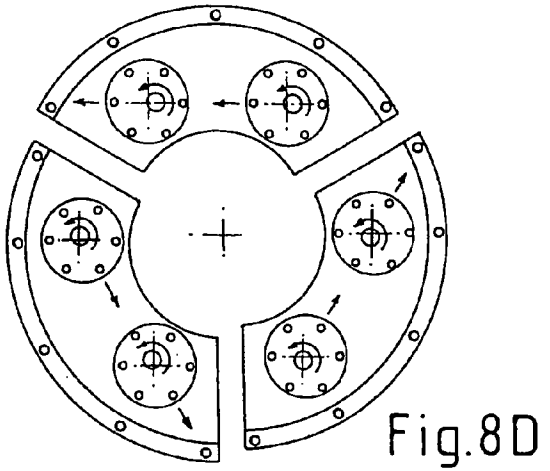
FIGS. 8A-8D illustrate schematically the sequence of the movements of the tool carriers in a drive device according to a fifth illustrative embodiment.
Figure 8C:
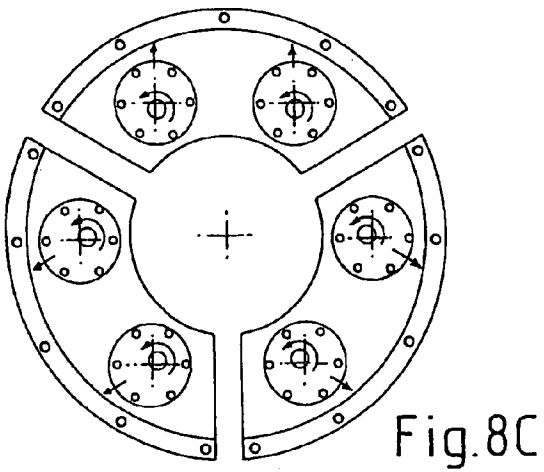
Figure 8A:
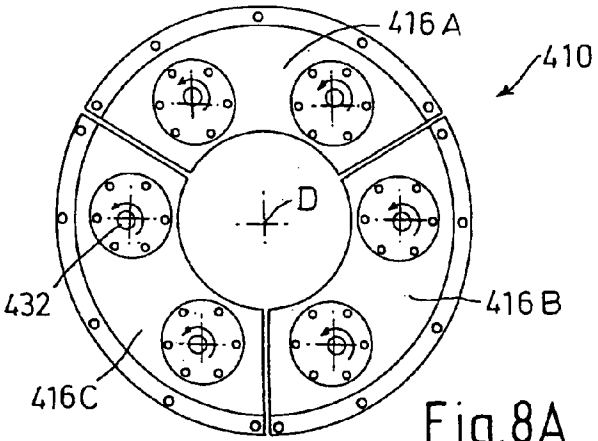
Figure 8B:
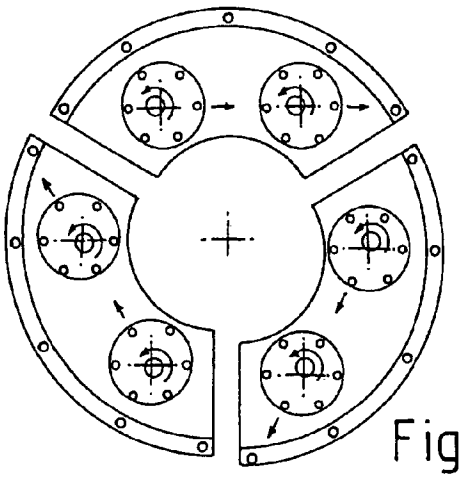

The arrangement of the tool carriers 216A, 216B and the arrangement of the eccentric component parts 232 of the intermediate shafts are represented schematically in FIGS. 6A-6D for a drive device 210 according to a third illustrative embodiment, in conjunction with which the individual representations A to D in each case illustrate the relative position of the tool carriers after a rotation of the intermediate shafts through 90°, but without taking into account the simultaneously occurring rotation of the sleeve carrier, and thus both tool carriers, about the axis of rotation D. The drive device 210, on the other hand, is provided with two semi-disc-shaped tool carriers 216A, 216B, in conjunction with which, however, only two intermediate shafts with eccentric component parts 232 are allocated to each tool carrier 216A and 216B. The axes of rotation 231 of the intermediate shafts 230 and the axis of rotation D of the carrier sleeve and the drive shaft are also represented in FIG. 6A. Through the oscillation-generating arrangements actuated by means of the eccentric component parts 232 and the intermediate shafts, the tool carriers 216A, 216B each experience an impulse I having a phase displaced through 180°, in conjunction with which this rotational impulse I for the one tool carrier 216A is out-of-phase on each occasion by 180° in relation to the impulse I for the other tool carrier 216B, as a consequence of which the two tool carriers 216A, 216B are dynamically balanced in relation to one another, as clearly illustrated by the sequence over FIGS. 6B, 6C and 6D, because the intermediate shafts in each case have continued to rotate through 90° between the individual representations. All of the intermediate shafts rotate in the same direction, as indicated by the arrows in each case.

In the case of the illustrative embodiment of a fourth drive device 310 in accordance with the invention in FIGS. 7A to 7D, a total of four tool carriers 316A, 316B, 316C, 316D in the form of quarter-disc segments are connected to the eccentric component parts 332 of two intermediate shafts in each case. The mutually opposing tool carriers 316A and 316C and 316B, 316D in each case form a pair and are activated with an oscillation that is out-of-phase by 180°, so that the pair of tool carriers 316A, 316C and 316D, 316B in each case is dynamically balanced in relation to one another. In addition, in the illustrative embodiment shown here, a further phase displacement of 90° is provided between the pairs, as illustrated in each case by the different positions of the eccentric component parts 232 relative to the shaft axes 331 of the intermediate shafts. The individual Figures in turn illustrate a movement sequence over a 360° rotation of the intermediate shafts, in conjunction with which each view shows a position for the situation of the tool carriers that is displaced through 90° in relation to the previous view, and the rotation of the carrier sleeve about the axis of rotation D is not taken into account.

In the case of the fifth illustrative embodiment of a drive device 410 shown in FIGS. 8A-8D, this illustrates three tool carriers 416A, 416B, 416C in the form of disc segments, to which two intermediate shafts for the oscillation superimposition rotating concentrically about the axis of rotation D are allocated in each case. The eccentric component parts 432 of the intermediate shafts of the tool carrier 416A are arranged in each case out-of-phase by 120° or rotated in relation to the eccentric component parts 432 of the intermediate shafts of the tool carriers 416B and 416C, so that each tool carrier 416A receives an oscillation superimposition having a phase displacement of 120° in relation to the two other tool carriers 416C, 416D. In this case, too, the phase displacement causes the three tool carriers 416A, 416B and 416C lying in a single plane to be dynamically balanced in relation to one another in respect of their impact impulse.

Figure 9:
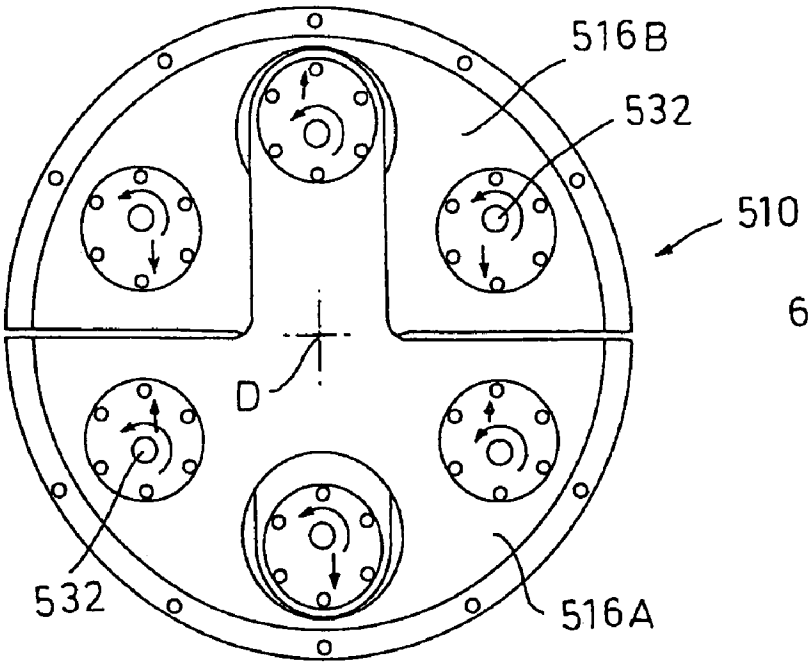
FIG. 9 illustrates a drive device according to a sixth illustrative embodiment as a front view of the tool carriers.

FIG. 9 shows a sixth illustrative embodiment of a drive device 510 in accordance with the invention with two tool carriers 516A and 516B, in conjunction with which the tool carrier 516B is arranged in a plane behind the tool carrier 516A. Three intermediate shafts with eccentric component parts 532 are allocated in each case to each tool carrier 516A, 516B, and the tool carrier 516A is superimposed with an oscillation impulse, which has a phase displacement of 180° in relation to the oscillation impulse for the tool carrier 516B. Both tool carriers 516A, 516B have a more or less spade-shaped contour, and in each case an intermediate shaft allocated to the tool carrier 516B is arranged between two intermediate shafts that are allocated to the tool carrier 516A. The pressing forces can be minimized during operation through the tool carriers 516A and 516B that are present in different planes, since the individual tool carriers 516A, 516B are never in engagement with the rock to be excavated in the same plane at the same time, but always attack the rock alternately and in different planes and loosen material there.

Figure 10:
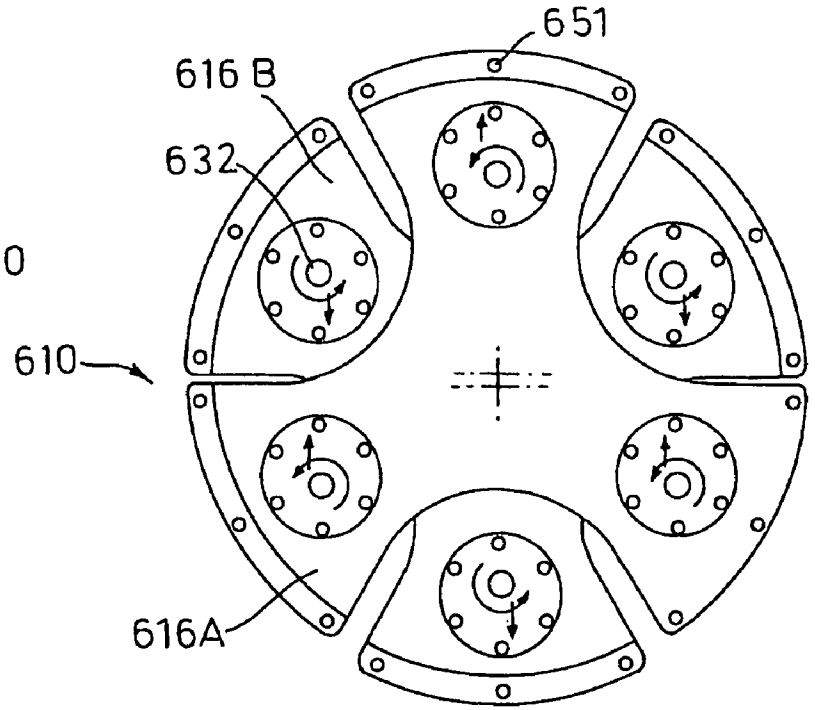
FIG. 10 illustrates a drive device according to a seventh illustrative embodiment as a front view of the tool carriers.

In the case of the seventh illustrative embodiment of a drive device 610 in FIG. 10, on the other hand, two tool carriers 616A, 616B are set in rotation and are activated with oscillation superimposition. The tool carriers can be executed essentially in the form of plates and can be arranged with their central areas lying behind one another, so that they and the working tools that are capable of being attached to them lie in different planes. However, the tool carriers 616A, 616B are preferably provided with corresponding and appropriate interleaving, so that the areas of both tool carriers 616A, 616B which accept the working tools lie in a single plane and only the central areas of both tool carriers are arranged in planes lying one behind the other. The interleaving can be achieved, for example, with forward-projecting off-sets on the rear tool carrier 616B and in addition, where appropriate, with rearward-displaced off-sets on the front tool carrier. Here, too, the intermediate shafts for one tool carrier 616A are adjacent in each case to two intermediate shafts for the other tool carrier 616B, and the eccentric components 632 of the individual intermediate shafts are arranged in such a way that the two tool carriers 616A, 616B that are out-of-phase by 180° in relation to one another are superimposed with the impact impulse. Both tool carriers 616A, 616B have an essentially star-shaped or propeller-shaped contour, and a partially annular segment-shaped tool holder can be attached to the screw attachments 651 on each tool carrier 616A, 616B. Every tool carrier 616A, 616B is connected to three intermediate shafts in each case. The ends of the individual struts of the propeller-shaped or star-shaped tool carriers can then be provided with the off-set.

Figure 4:
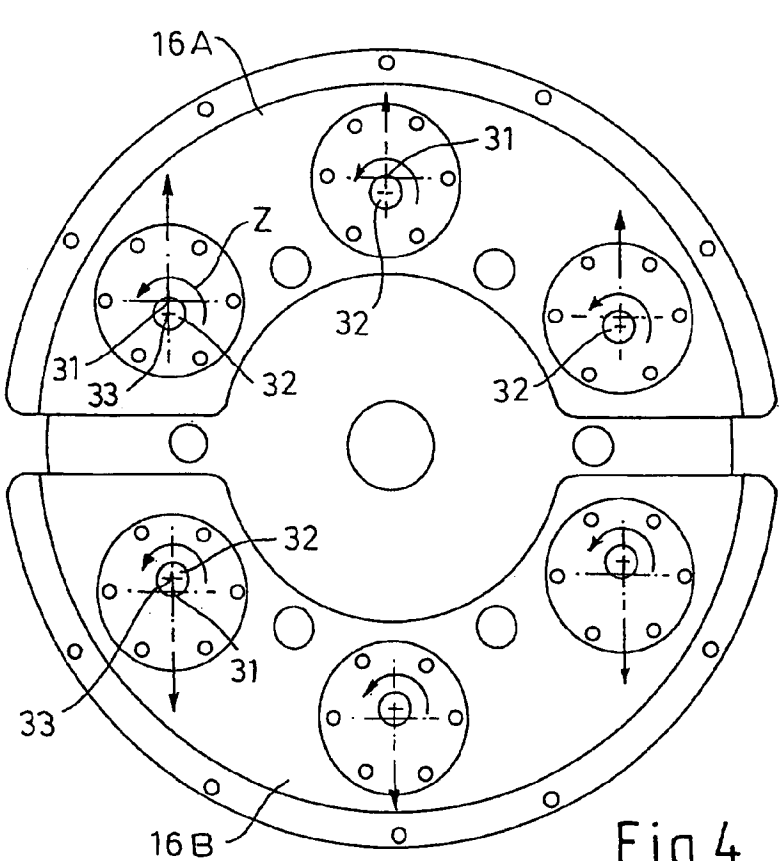
FIG. 4 is a view from the front of the tool carrier of the drive device illustrated in FIG. 3.
Figure 12:
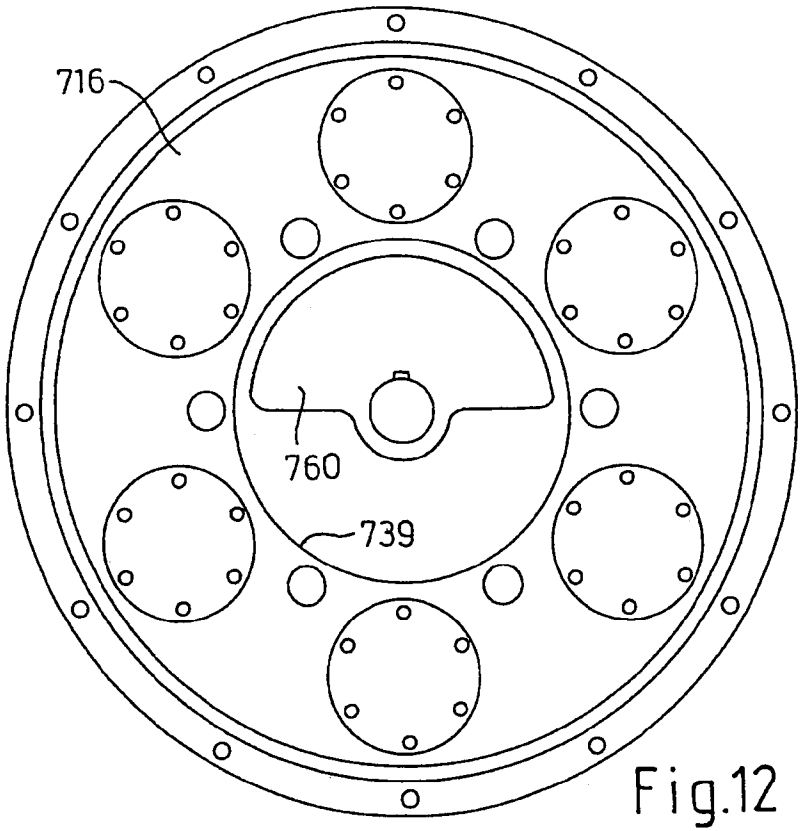
FIG. 12 illustrates a view of the tool carriers in the drive device shown in FIG. 11.
Figure 11:
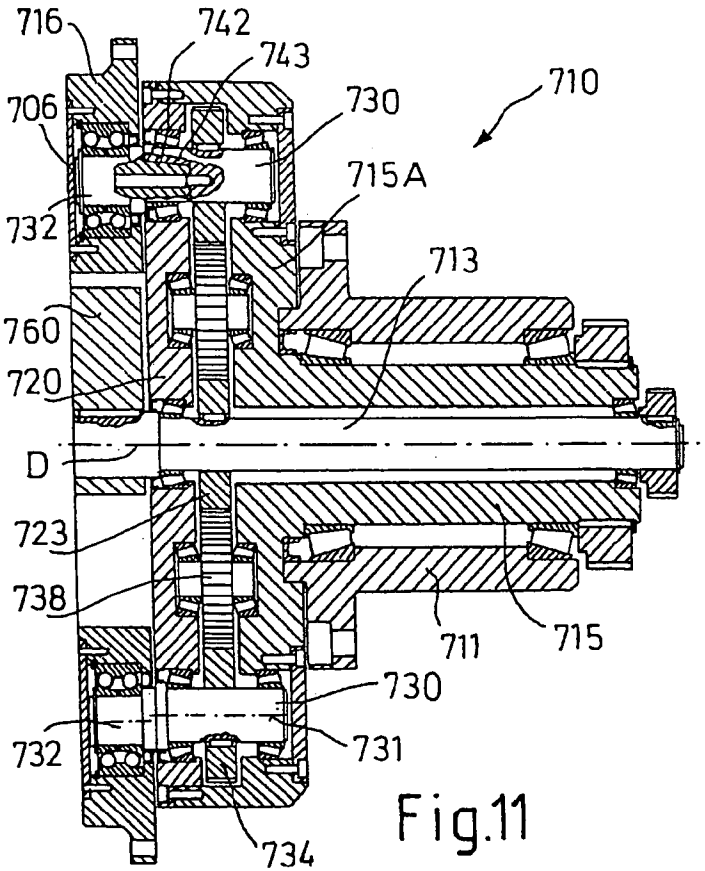
FIG. 11 illustrates a drive device according to an eighth illustrative embodiment as a vertical section.

FIGS. 11 and 12 show an eighth illustrative embodiment of a drive device 710 in accordance with the invention as a view corresponding to FIGS. 3 and 4. A drive shaft 713 and a carrier sleeve 715 are rotatably supported about the same axis of rotation D in a drive housing 711. The head 715A of the carrier sleeve 715 is of a more solid execution than in the first illustrative embodiment, and intermediate wheels 738 are supported between the head 715A and the sealing disc 720 in addition to a central toothed wheel 723 represented here with relatively small dimensions and rigidly connected to the drive shaft 713 and the planet wheels 734 rigidly attached to the intermediate shafts 730. A toothed gear mechanism with a reduction ratio of 1:1 between the drive shaft 713 and the intermediate shafts 730 is achieved with the toothed wheels 734, 738 and 723. All of the intermediate shafts 730 exhibit an eccentric component part here, which consists of a shaft prolongation 732 arranged eccentrically to the shaft axis 731 of the intermediate shafts 730, which exhibits a conical pin projection 742, which is inserted into a similarly conical depression 743 in the intermediate shafts 730. The projection 742 and the depression 743 are secured by means of a screw locking means, which can be released from the front side of the tool carrier 716 after removing the hatch covers 706. In this way, the entire tool carrier 716 can be pulled away from the drive housing 711 towards the front. It becomes clear, in particular when considered together with FIG. 12, that the drive device 710 exhibits only a single tool carrier 716, on which the impact impulse is superimposed with a total of six intermediate shafts. A balance weight 760 is rigidly connected to the drive shaft 713 for the purpose of balancing any dynamic imbalance, which weight is arranged out-of-phase by 180° in relation to the arrangement and to the eccentric offset of the eccentric component parts and runs out-of-phase by 180° in the same direction because of the reduction ratio of the toothed gear mechanism, so that the balance weight 716 counterbalances the impact movement of the tool carrier 716. The balance weight 760 in this case rotates in a central recess 739 on the internal periphery of the tool carrier 716.

Numerous modifications, which should fall within the scope of the protection afforded by the dependent claims, will be evident from the foregoing description to a person skilled in the art. In the case of tools and drive devices with larger dimensions, three or more intermediate shafts can also be allocated to every tool carrier. This embodiment also retains in full the particular advantage that the intermediate shafts with the eccentric component parts possess significantly smaller dimensions than in drive devices with eccentrically broad carrier sleeves. The possibility of connecting the drives for the drive shafts and the drives for the carrier sleeve directly to one another via a suitable gear arrangement is not represented. Also not represented is the ability to regulate the speed of the intermediate shaft drive, the speed of the carrier sleeve drive and the rate of feed for the tool as a whole in a way in which they are matched to one another and in particular with reference to the speed of the intermediate shaft drive, via a superior control device. The eccentric offset can be 7.5 mm, for example, for a speed of rotation of the carrier sleeve of 100-150 revolutions/min, and for an impact superimposition or oscillation of around 3200/min, so that a speed ratio $N_Z$ for the intermediate shafts and $N_T$ for the carrier sleeve in the order of 20:1 to 35:1 can be obtained. The detachable attachment between the eccentric component parts and the intermediate shafts can also be effected by means of an oil press fit connection. For example, eight working tools with an angular offset of 45° in relation to one another can be attached to the tool carriers. Torsionally elastic couplings can be installed between the drive shaft and/or the carrier sleeve and their drives, for example consisting of electric motors, which couplings can be equipped additionally with an overload function in order to prevent damage to the drive devices or the drives in the event of blockages. The working tools, such as round chisel bits, discs, flat chisel bits and the like can also be attached directly to the tool carrier. The gap between the segment-shaped tool carriers can be covered with plates and the like.

The invention claimed is:

1. A drive device for rotating tools operating with oscillation superimposition, comprising:

a drive housing;

a carrier sleeve mounted rotatably in the drive housing;

a drive shaft mounted rotatably in the carrier sleeve;

at least one a tool carrier to receive working tools; and an oscillation-generating mechanism for generating the oscillation superimposition for the tool carrier wherein the oscillation-generating mechanism for each tool carrier includes at least two intermediate shafts, each intermediate shaft being connected to the tool carrier via an eccentric component part and each intermediate shaft being driven synchronously.

2. The drive device according to claim 1, wherein each of the intermediate shafts are supported in bearings concentrically to an axis of rotation of the drive shaft in the carrier sleeve.

3. The drive device according claim 1, wherein the drive shaft and the carrier sleeve are supported in bearings concentrically to an axis of rotation of the drive shaft.

4. The drive device according to claim 1, wherein the intermediate shafts are connected to the drive shaft via a toothed gear mechanism.

5. The drive device according to claim 4, wherein the toothed gear mechanism includes a central toothed wheel that is rigidly connected to the drive shaft, and planet wheels that are each rigidly connected to the intermediate shafts and in toothed engagement with the central toothed wheel.

6. The drive device according to claim 4, wherein the toothed gear mechanism includes a central toothed wheel connected rigidly to the drive shaft, a plurality of planet wheels that are each rigidly connected to the intermediate shafts, and a plurality of intermediate toothed wheels each supported in bearings in the carrier sleeve and arranged between the central toothed wheel and the planet wheels.

7. The drive device according to claim 1, wherein each of the eccentric component parts is a constituent part of the intermediate shafts and includes an eccentric pin arranged eccentrically to a central axis of the intermediate shaft.

8. The drive device according to claim 1, wherein each of the eccentric component parts includes a shaft prolongation arranged eccentrically to a central axis of the intermediate shaft, the shaft prolongations being detachably connected to the intermediate shaft.

9. The drive device according to claim 8, wherein each of the intermediate shafts and the shaft prolongations are connected via a conical pin projection, which engages in a corresponding conical depression, and the connection between each of the intermediate shafts and the shaft prolongations is rigid and is secured by a locking mechanism.

10. The drive device according to claim 1, wherein each of the eccentric component parts includes a plurality of sleeves each having an eccentric shaft seat, and a shaft pin positioned concentrically to the intermediate shaft is engaged with each shaft seat.

11. The drive device according to claim 10, wherein the shaft seat and the shaft pin are conical and engage rigidly into one another, and the rigid connection is secured by a locking mechanism.

12. The drive device according to claim 9, wherein the rigid connection includes one of an oil press fit connection or a press fit between the conical parts, and the rigid connection is releasable under hydraulic pressure.

13. The drive device according to claim 1, wherein one or more pivot bearings are arranged between the eccentric component part and the tool carrier.

14. The drive device according to claim 1, wherein the tool carrier is a first tool carrier, and further comprising one or more additional tool carriers, with at least two intermediate shafts being connected to each tool carrier, and an oscillation produced by the oscillation-generating mechanism for the first tool carrier is out-of-phase in relation to one or more oscillations produced by oscillation-generating mechanisms associated with the one or more additional tool carriers.

15. The drive device according to claim 1, wherein the tool carrier is a first tool carrier, and further comprising one or more additional tool carriers, a total quantity of tool carriers is an even number, the tool carriers being positioned such that each tool carrier is opposed by another tool carrier, and the even number of tool carriers, are superimposed with an oscillation impulse having a phase displaced by 180° through an arrangement of the eccentric component parts of the intermediate shafts of the associated oscillation-generating mechanisms.

16. The drive device according to claim 1, wherein the tool carrier is a first tool carrier, and further comprising two additional tool carriers, and the three tool carriers, are superimposed with an oscillation impulse having a phase displaced by 120° through an arrangement of the eccentric component parts of the intermediate shafts of the associated oscillation-generating mechanisms.

17. The drive device according to claim 1, wherein the tool carrier is a first tool carrier, and further comprising at least one additional tool carrier, and the first tool carrier and the at least one additional tool carrier are arranged in different planes and superimposed with an oscillation impulse having a phase displaced by 180° through an arrangement of the eccentric component parts of the intermediate shafts of the oscillation-generating mechanisms.

18. The drive device according to claim 17, wherein three intermediate shafts are allocated to each tool carrier, and the three intermediate shafts are distributed alternately around the periphery of the drive housing.

19. The drive device according to claim 17, wherein the tool carriers are one of spade-shaped or star-shaped.

20. The drive device according to claim 17, wherein the tool carriers are provided with one of interleaved or off-set location areas positioned in a single plane for tool carriers or working tools.

21. The drive device according to claim 1, further comprising:

an individual tool carrier; and a balance weight, the balance weight rotating about a drive axis of the drive shaft and having a phase displacement of 180° in relation to an oscillation impulse generated by the eccentric components of the intermediate shafts associated with the individual tool carrier.

22. The drive device according to claim 14, further comprising one of at least one single-component or at least one multiple-component tool holder in the form of an annular segment and attached to each tool carrier, and each tool holder includes one or more attachment devices for a plurality of working tools.

23. The drive device according to claim 1, wherein the working tools include one of self-sharpening round chisel bits, flat chisel bits, discs, or cross roller bits.

24. The drive device according to claim 1, wherein each of the intermediate shafts are driven at a first speed Nz, the carrier sleeve is driven at a second speed Nt, and a speed ratio Nz/Nt is one of equal to or greater than 22.

25. The drive device according to claim 1, wherein the carrier sleeve is driven with a carrier sleeve drive, the intermediate shafts are driven with an intermediate shaft drive allocated to the drive shaft, and a feed speed for the drive device is adjustable via a feed drive mechanism, whereby a control device controls the carrier sleeve drive and the feed drive based on the intermediate shaft drive.

26. A tool having a drive device, the drive device comprising:

a drive housing, a carrier sleeve mounted rotatably in the drive housing, a drive shaft mounted rotatably in the carrier sleeve, at least one tool carrier to receive working tools, and an oscillation-generating mechanism for generating an oscillation superimposition for the tool carrier, wherein the oscillation-generating mechanism for each tool carrier includes at least two intermediate shafts, each of the shafts being connected in to the tool carrier via an eccentric component part and capable of being driven synchronously.

27. The drive device according to claim 11, wherein the rigid connection includes one of an oil press fit connection or a press fit between the conical parts, and the rigid connection is releasable under hydraulic pressure.

* * * * *